US005918816A

United States Patent [19]

Huber

[11] Patent Number: 5,918,816

[45] **Date of Patent: *Jul. 6, 1999**

[54] MULTIFUNCTION HAND SHOWER

[75] Inventor: Roland Huber, Henschiken, Switzerland

[73] Assignee: Hansa Metallwerke AG, Germany

[ * ] Notice: This patent is subject to a terminal disclaimer.

[21] Appl. No.: 08/617,206

[22] Filed: Mar. 18, 1996

[30] Foreign Application Priority Data

Mar. 17, 1995 [DE] Germany ..... 195 09 659

[51] Int. Cl.[6] ..... A62C 31/02

[52] U.S. Cl. ..... 239/391; 239/438; 239/444; 239/525; 239/552

[58] Field of Search ..... 239/390, 391, 239/436, 438, 443, 444, 447, 525, 548, 552, 554, 586, DIG. 1

[56] References Cited

U.S. PATENT DOCUMENTS

| | | | |
|---|---|---|---|
| 3,473,736 | 10/1969 | Heitzman | 239/101 |
| 4,010,899 | 3/1977 | Heitzman | 239/101 |
| 4,203,550 | 5/1980 | On | 239/447 |
| 4,588,130 | 5/1986 | Trenary et al. | 239/447 |
| 4,629,124 | 12/1986 | Gruber | 239/447 |
| 4,629,125 | 12/1986 | Liu | 239/443 |
| 4,703,893 | 11/1987 | Gruber | 239/391 |
| 4,754,928 | 7/1988 | Rogers et al. | 239/447 |
| 4,838,486 | 6/1989 | Finkbeiner | 239/391 |
| 4,903,897 | 2/1990 | Hayes | 239/525 |
| 5,100,055 | 3/1992 | Rokitenetz et al. | 239/436 |
| 5,145,114 | 9/1992 | Monch | 239/447 |
| 5,356,077 | 10/1994 | Shames et al. | 239/447 |
| 5,356,078 | 10/1994 | Bischoff | 239/447 |
| 5,397,064 | 3/1995 | Heitzman | 239/99 |

FOREIGN PATENT DOCUMENTS

| | | |
|---|---|---|
| 3509602 | 9/1986 | Germany . |
| 43 07 776 | 7/1994 | Germany . |
| 9411112 | 5/1994 | WIPO . |

*Primary Examiner*—Andres Kashnikow
*Assistant Examiner*—Lisa Ann Douglas

[57] ABSTRACT

A multifunction hand shower can be used in at least two modes of operation: in the first of these modes of operation, the shower jets emerge from the shower base (3) in a constant stream at relatively high speed and with a small cross-section ("hard jet mode") and in the second mode of operation they emerge at high speed and with a relatively small cross-section, but are intermittently interrupted ("pulse jet mode"). The periodic interruption of the "pulse jets" is ensured by a pulse wheel (23) which is housed in a circular chamber (20) in the housing (1) in such a way that it can rotate. In the "hard jet mode", the rotation of the pulse wheel (23) is interrupted, by a stop (45), in a quite specific angular position which allows the hard jets to emerge from the shower base (3) in a constant stream. To change over to "pulse jet mode", the stop (45) is moved out of the path of movement of a stop (28) which is connected to the pulse wheel (23) such that the pulse wheel (23) is now able to rotate freely. The paths taken by the water inside the housing (1) and especially the water outlet openings (4) through which the water flows are the same in the "hard jet mode" and the "pulse jet mode".

16 Claims, 11 Drawing Sheets

MULTIFUNCTION HAND SHOWER

Figure 1:
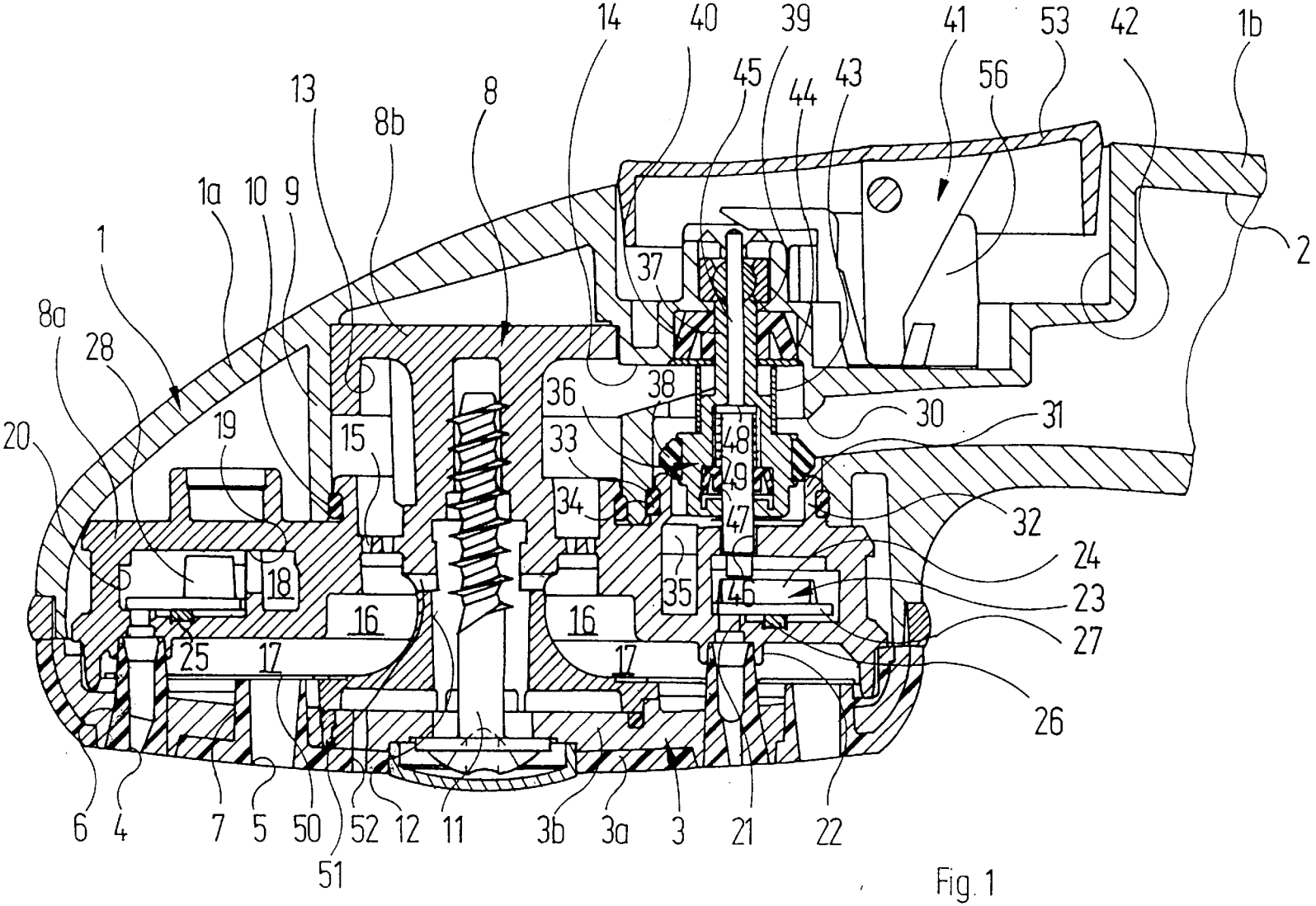

The invention concerns a multifunction hand shower with a choice of at least two modes of operation in which the shower jets emerge with a relatively small cross-section and a relatively high speed, namely in a) a first mode of operation in which the shower jets emerge in a continuous stream ("hard jet mode")

and b) a second mode of operation in which the shower jets are periodically interrupted ("pulse jet mode")

comprising c) a housing;

d) a shower base which seals the housing and which has a number of water outlet openings;

e) a pulse wheel pivot mounted in a circular chamber in the housing through which water flows, and which as it rotates periodically interrupts and then frees the through-flow of water to the appropriate water outlet openings in the shower base;

f) a change-over mechanism to select the mode of operation which consists of fa) a manual actuator;

fb) at least one change-over device which is controlled by the manual actuator and which can be moved into at least two different positions, hereby determining the mode of operation of the shower.

In the known multifunction hand showers of this type, in the "hard jet" and "pulse jet" modes water takes different paths as it flows through the housing and also flows through different water outlet holes in the shower base. In one of these paths there is a circular chamber in which the pulse wheel runs. The change-over from one mode of operation to the other occurs by means of a valve component which directs the flow of water to either one of the two water channels appropriate to the corresponding mode of operation. The disadvantage with this arrangement is that the internal assembly of the housing is relatively complicated due to the different water channels required, that in addition the water channels are relatively narrow and, more especially, that the water outlet openings in the shower base are different for "hard jet mode" and "pulse jet mode". The consequence of this is that only comparatively few water outlet openings are available for both the "hard jet mode" and also the "pulse jet mode". This assumes particular significance when, in addition to the two modes of operation of the multifunction hand shower described, there is potential for a third mode of operation ("soft jet mode"). There is also the fact that in the known types of shower the jet pattern is different in the "hard jet mode" than it is in the "pulse jet mode".

The task of this invention is to design a multifunction hand shower of the type described at the beginning so that its internal assembly is simplified, the internal water channels have a large-area cross-section of flow, there is as high a number of water outlet openings in the shower base available for "hard jet mode" and "pulse jet mode" as possible and there is an adequate jet pattern over a wide area of the shower base.

This problem is solved according to the invention in that g) the change-over device acts upon a stop which, in the first position of the change-over device lies outside the path of movement of a stop mounted on the pulse wheel and in the second position of the change-over device lies in the path of movement of the stop on the pulse wheel such that the pulse wheel remains in a specific position of rotation.

In a multifunction hand shower according to the invention the previously adopted course is therefore abandoned whereby each mode of operation has its own water channel and its own set of outlet holes in the shower base. Instead, in those modes of operation in which jets of water are produced which have a relatively high speed and small cross-section (and this applies not only to "hard jet mode" but also to "pulse jet mode") the water is directed via the same water channel and via the same water outlet holes. According to the invention, the respective mode of operation is selected by either stopping the pulse wheel which is pivot mounted in a circular chamber inside the water channel ("hard jet mode") or leaving it to rotate freely ("pulse jet mode"). This can be brought about with the aid of a stop which is very simply moved into the path of motion of a stop mounted on the pulse wheel.

In one embodiment of the invention, the change-over device extends to the outside of the housing in a radial direction relative to the shower base. In this embodiment, the manual actuator is on a lateral face of the bell-shaped extension to the housing of the hand shower or even on to a peripheral surface of the shower base.

Alternatively, it is possible for the change-over device to be moved from the shower base in an axial direction. In this embodiment, a corresponding change-over device, which is simply adjusted axially between two positions, is then located on the front face of the shower base.

The preferred embodiment of the invention is one in which the change-over device is part of a change-over mechanism, with which a third mode of operation can also be set in which air-enriched shower jets emerge from the shower base with a relatively large cross-section and at a comparatively slow speed ("soft jet mode"). In the embodiment described, the change-over mechanism can combine all three modes of operation and can be operated as necessary by a single manual actuator.

In this connection, a particularly good embodiment of the invention is one in which the change-over mechanism consists of:

fc) a slide which is contained in the housing and which can be moved either translationally or rotationally by the manual actuator and which can be set at three different positions corresponding to the three modes of operation of the hand shower;

fd) an additional change-over device which can be set at two different positions by means of the slide via a guide and cam mechanism, whereby the first position is selected for the "soft jet mode" and the second position is selected both for the "hard jet mode" and also the "pulse jet mode", whereby fe) a spring presses the change-over device which effects the change-over between "hard jet mode" and "pulse jet mode" into one of its two positions and ff) the slide has a stop which, in one position of the slide, holds the change-over device effecting the change-over between "hard jet model" and "pulse jet mode" against the force of the spring in one of the two positions and, in a second position of the slide, allows the spring to push this change-over device into the other of the two positions.

In a preferred embodiment of the invention, the additional change-over device loads a two-way valve cone which acts in combination with two valve seats formed in the housing. This two-way valve cone is then able to distribute the water flowing through the handle of the hand shower to two water channels: the first water channel leads to devices built into the housing of the shower which enrich the water with air and from there to relatively large water outlet openings. This produces soft jets of water. The other water channel is designed for the two modes of operation in which hard jets or pulsed hard jets are produced, and a choice can then be made between these two modes of operation using the second change-over device.

From a geometry point of view it is expedient if the two change-over devices can be moved parallel to each other and perpendicular to the direction of movement of the slide. It is then easy to move the slide parallel to the wall of the housing of the hand shower. A movement of the change-over devices parallel hereto leads into the housing where the moving components are located.

A particularly space-saving configuration is one in which the second change-over device is carried coaxially inside the hollow first change-over device. It is then a simple matter to use this configuration also prevent the movement of the second change-over device in the first position of the first change-over device by means of appropriate stops.

In the embodiment of a hand shower according to the invention the manual actuator can be a rocker which can be moved clockwise from a centre first position into a second position and anticlockwise into a third position. The use of rockers as actuators for sanitary components are, in themselves, well-known and common because they are simple to operate and can be housed on the appropriate sanitary component to make them visually pleasing. However the commonly known rockers have only two different positions of movement, whilst in the design of hand shower according to the invention there is also a centre position of the rocker.

The transfer of forces from the rocker to the slide can, for example take place, by preforming an actuating finger on to the rocker which engages in a guide recess in the slide. The rotating motion of the actuating finger on the rocker can in this way be converted simply into a linear motion of the slide.

A particularly preferred embodiment of the invention is one in which the guide and cam mechanism works symmetrically relative to the centre position of the slide whereas the stop on the slide operates asymmetrically relative to the centre position of the slide in the sense that it prevents any movement of the second change-over device into the second position only when the slide is in an out-of-centre position. In this embodiment of the invention, the centre position of the slide corresponds to the first mode of operation in which the first change-over device adopts its first position. Irrespective of the direction in which the slide is now moved from this centre position, the first change-over device is always moved into the second position owing to the symmetrically designed guide and cam mechanism. Since, however, the direction of movement of the slide from the centre position into the two out-of-centre positions occurs in opposite directions, it is easy from a geometrical point of view to ensure that in one of these out-of-centre positions the stop on the slide engages the second change-over device and stops it in its first position, whereas in the second out-of-centre position it releases the second change-over device and allows it to advance into its preferred position.

A symmetrically operating guide and cam mechanism of this type can most simply be achieved by a or several V-shaped guide slit(s) acting in combination with a or several guide pin(s) on the first change-over device. In the centre position of the slide, each guide pin is located in the apex of the corresponding V. Any lateral movement of the slide then pushes the guide pin along the corresponding side of the V so that a corresponding movement of the first change-over device in this same direction occurs, irrespective of the direction in which the slide is moved from the centre position.

It is advisable for the first change-over device to consist of:

a) a shaft part with a partially spherical head;

b) a guide ring with a partially spherical interior space in which the partially spherical head of the shaft part is accommodated so that it is form fit but also so that it can be rotated.

This configuration allows the first change-over device to turn so that in the event of any misalignment or angle errors inside the housing there is no risk of the first change-over device becoming jammed.

The stop on the slide can, for expediency, be formed by an arm projecting from the slide vertical to the direction of movement of the second change-over device. This arm then overlaps the free end of the second change-over device in the position in which the latter should be stopped against the force of the spring in the first position.

A cam surface which is set so that it is at an angle to the direction of movement of the slide can be fitted to the free end of the arm. If, therefore the slide is moved back from the out-of-centre position which corresponds to the second position of the second change-over device into the centre position, then, with the aid of the inclined cam surface, the second change-over device is pushed back into its first position against the force of the spring.

Figure 2A:
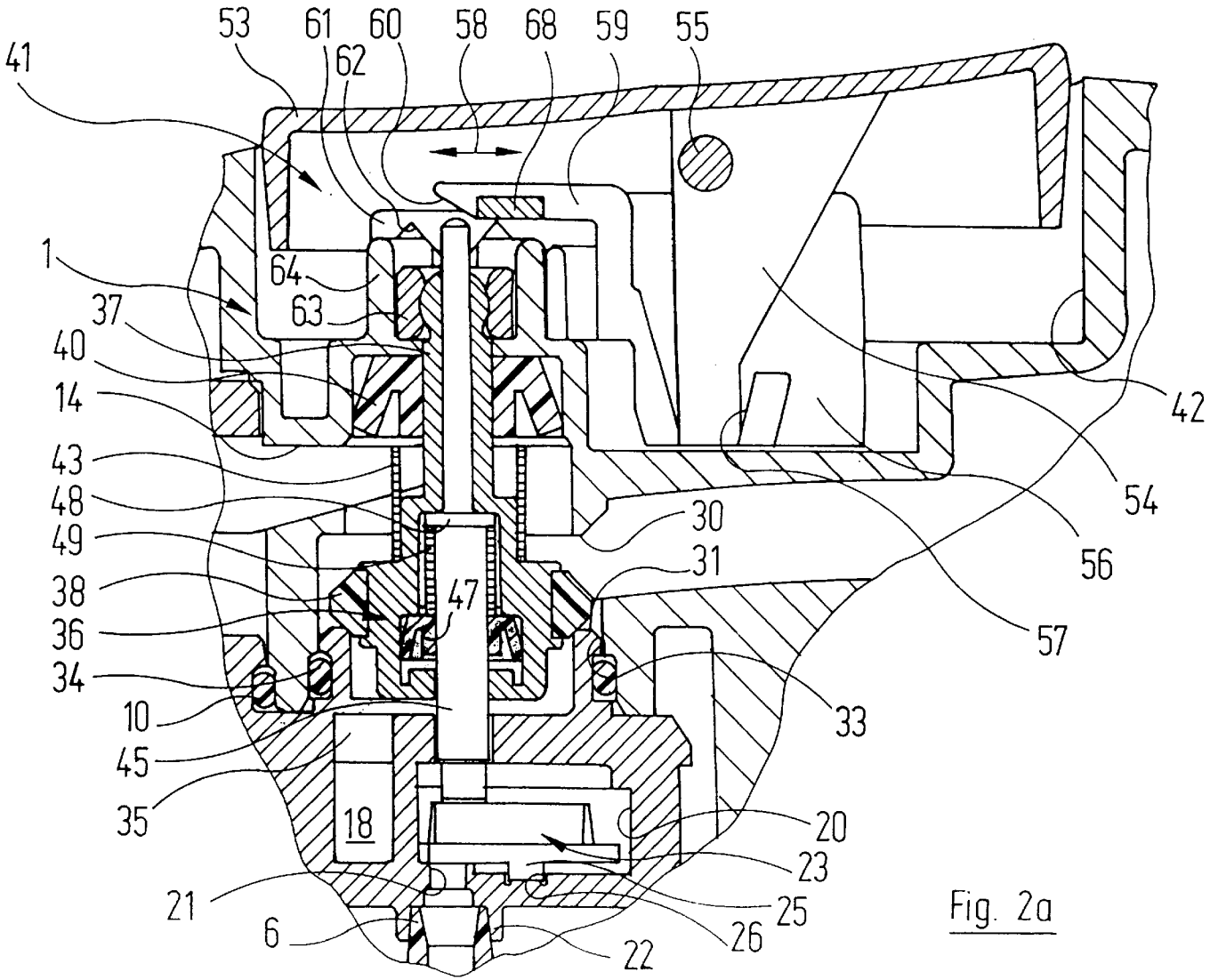
Figure 2B:
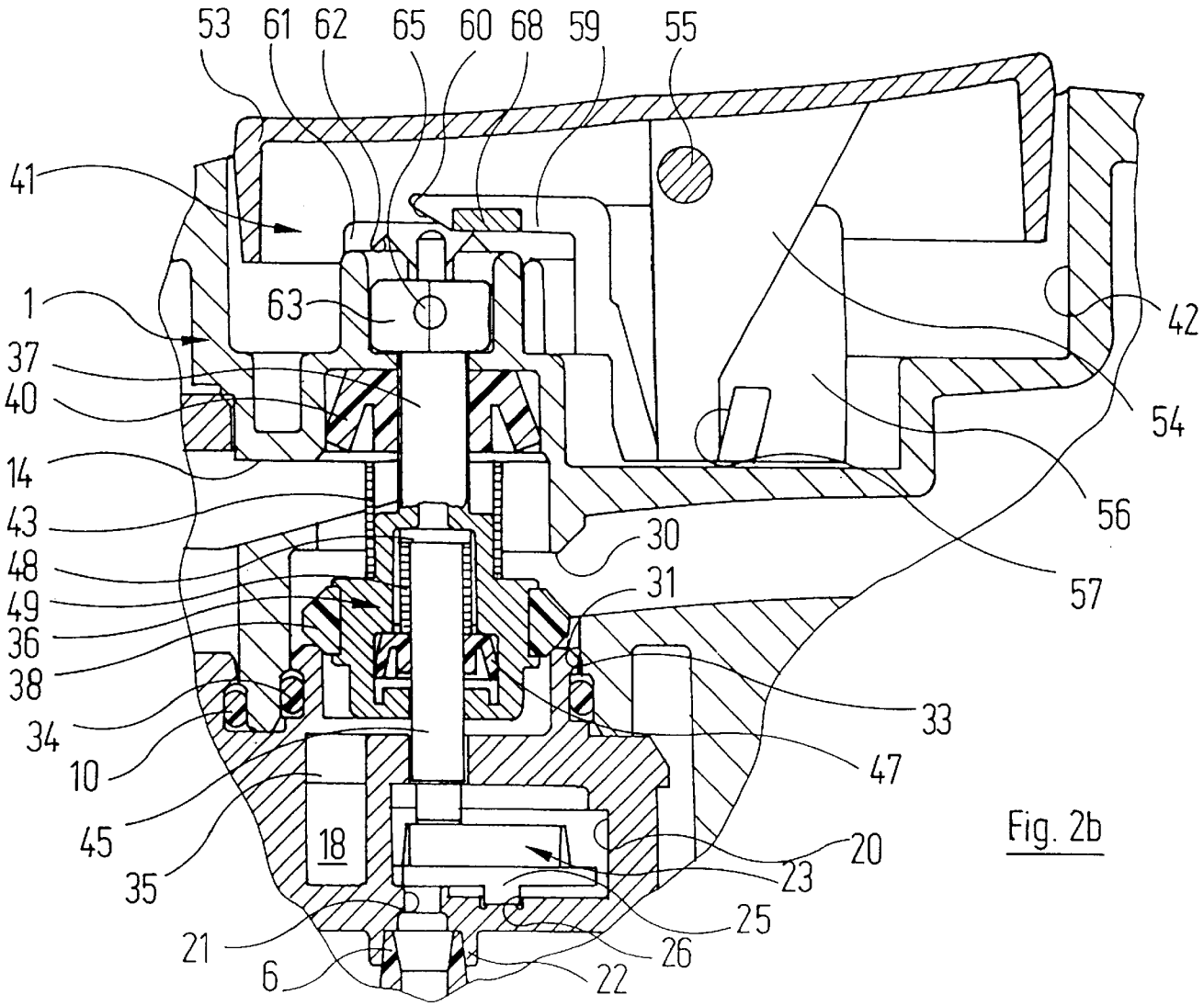
Figure 2C:
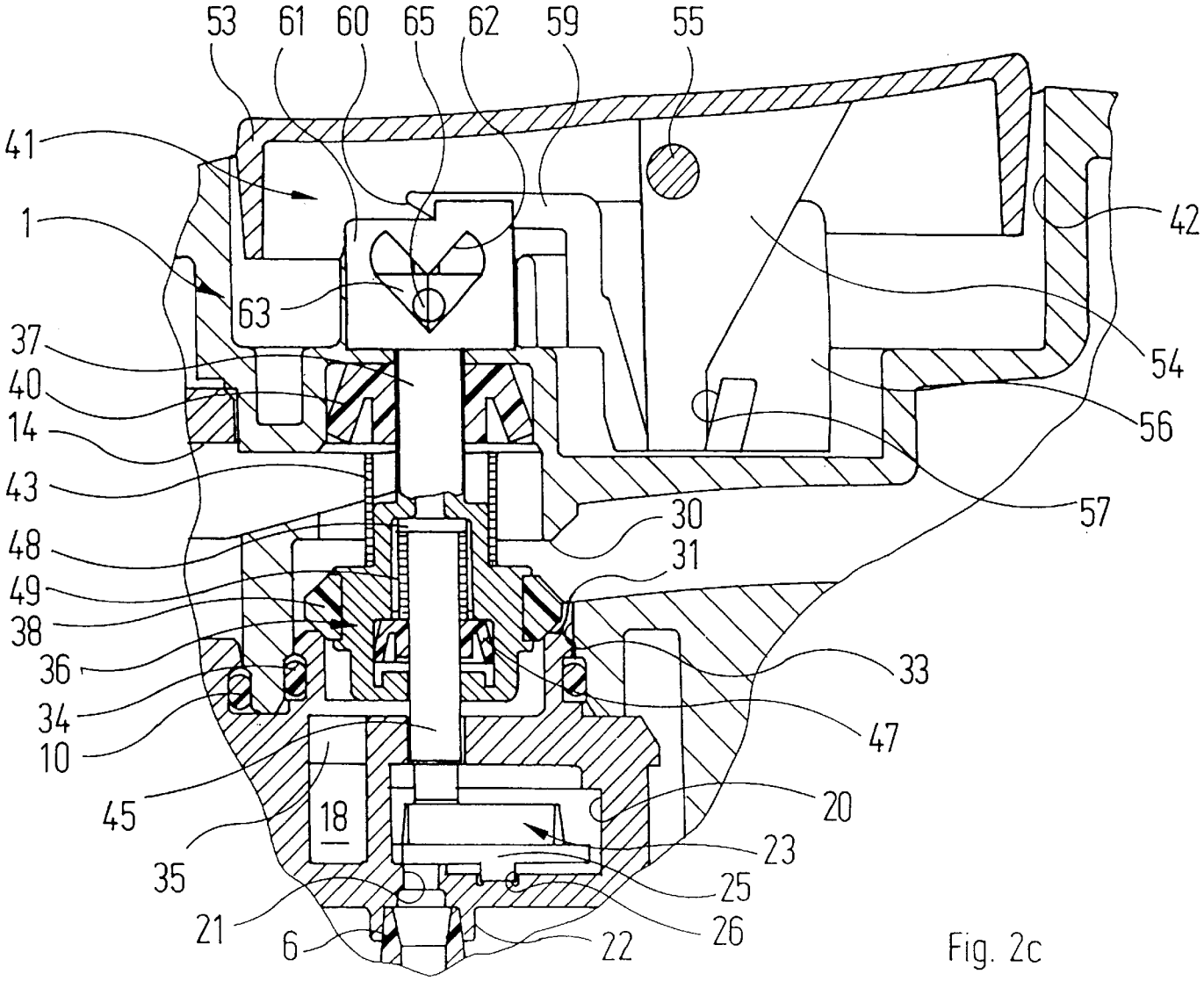
Figure 3A:
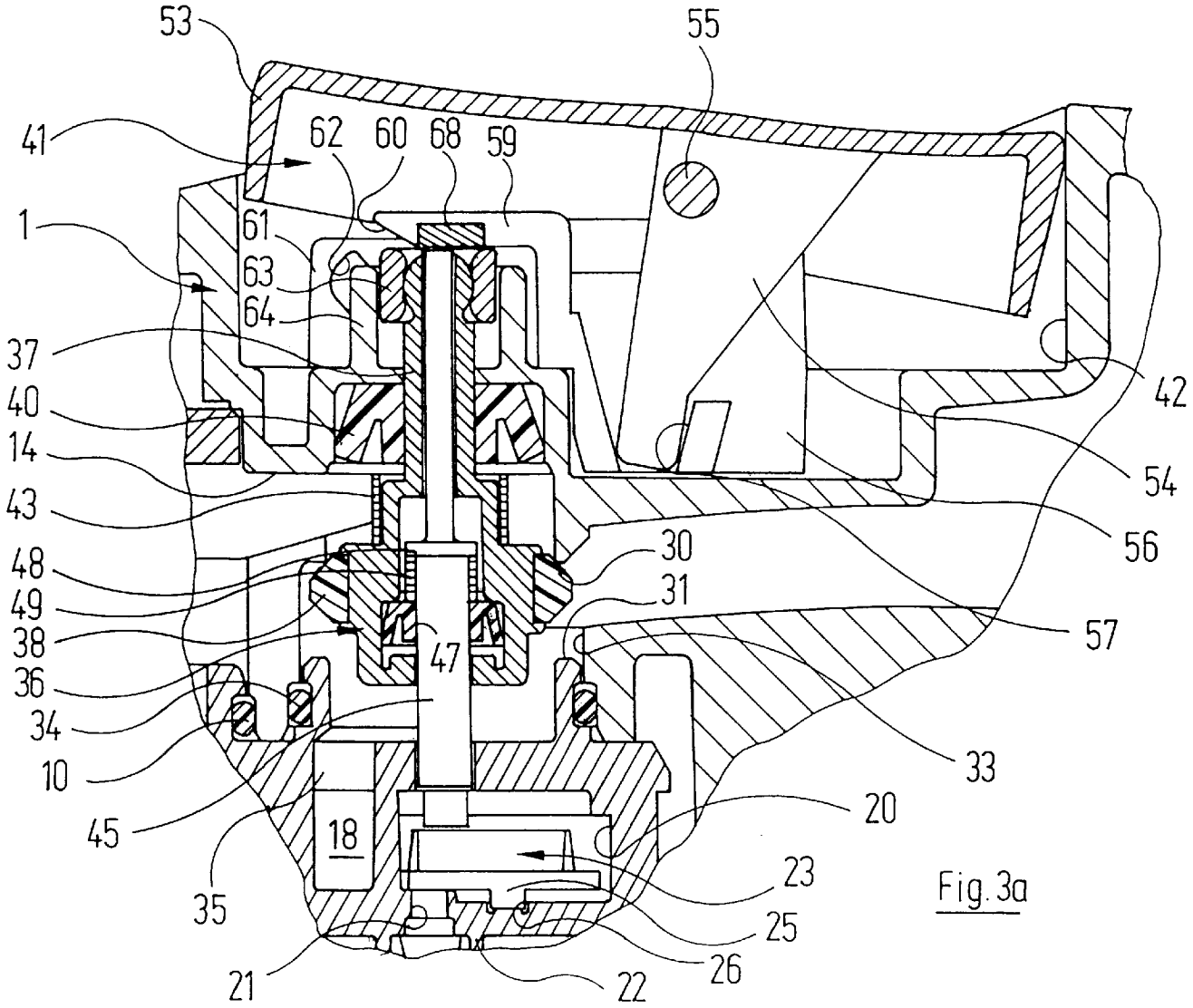
Figure 3B:
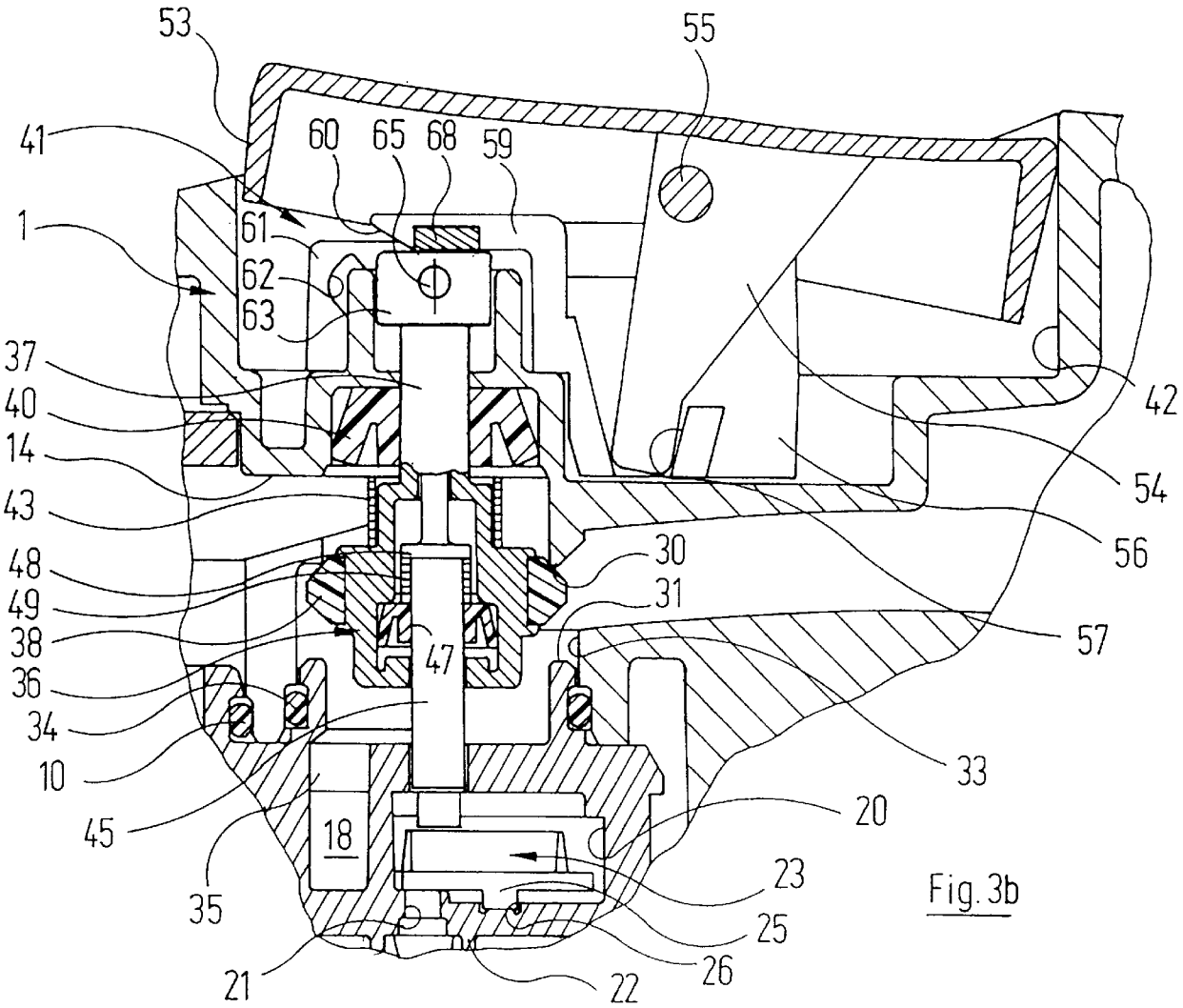
Figure 3C:
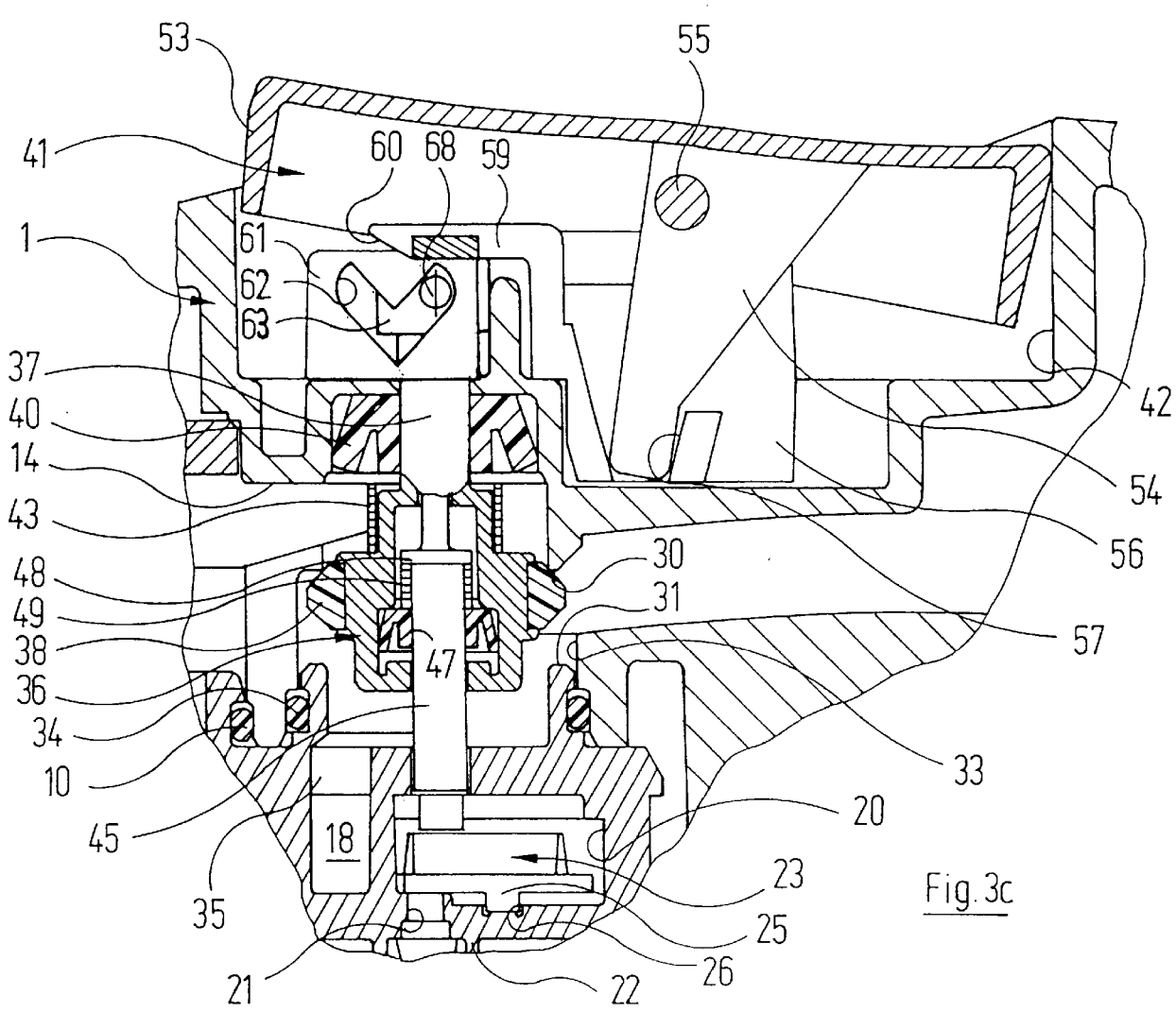
Figure 4A:
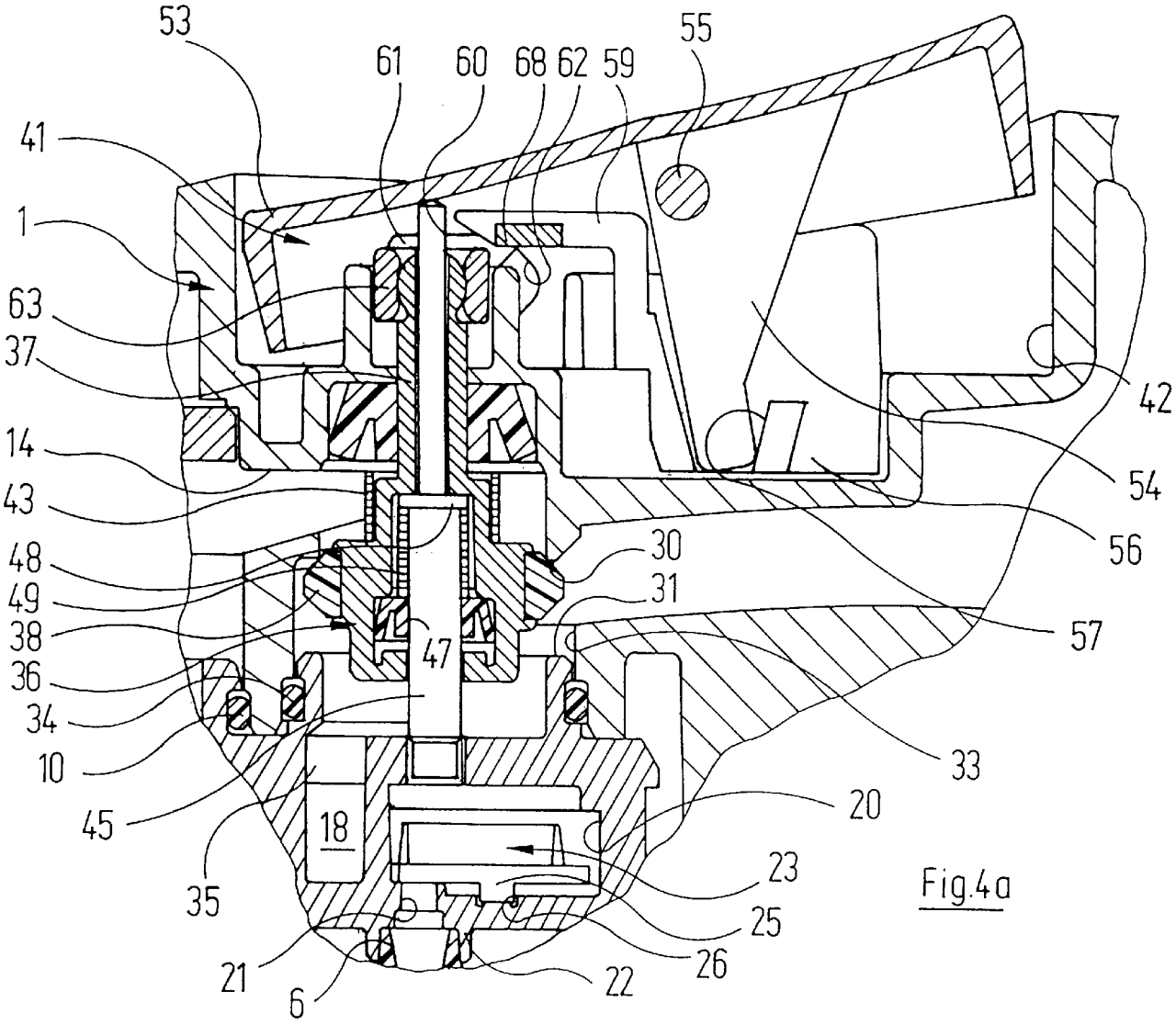
Figure 4B:
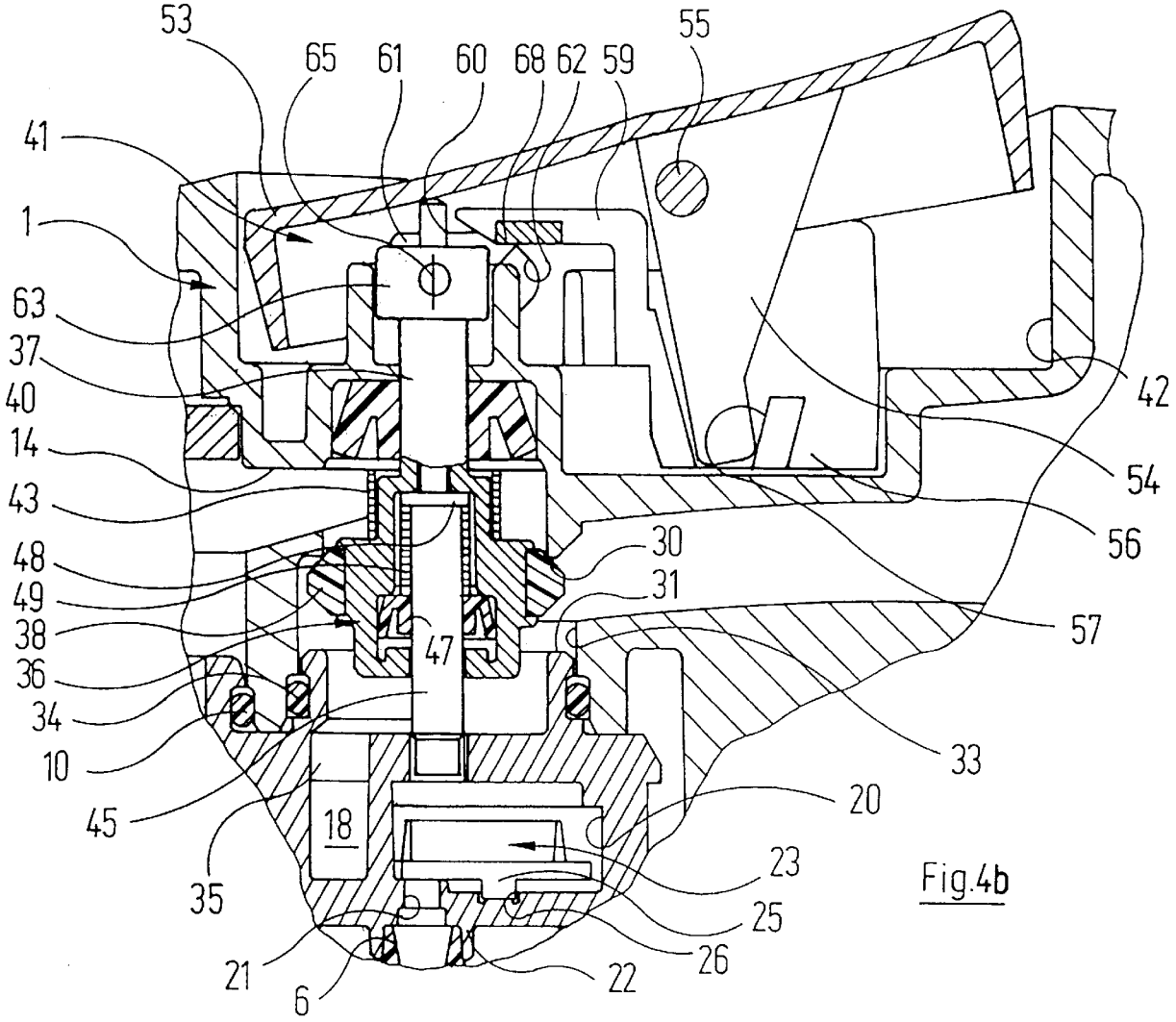
Figure 4C:
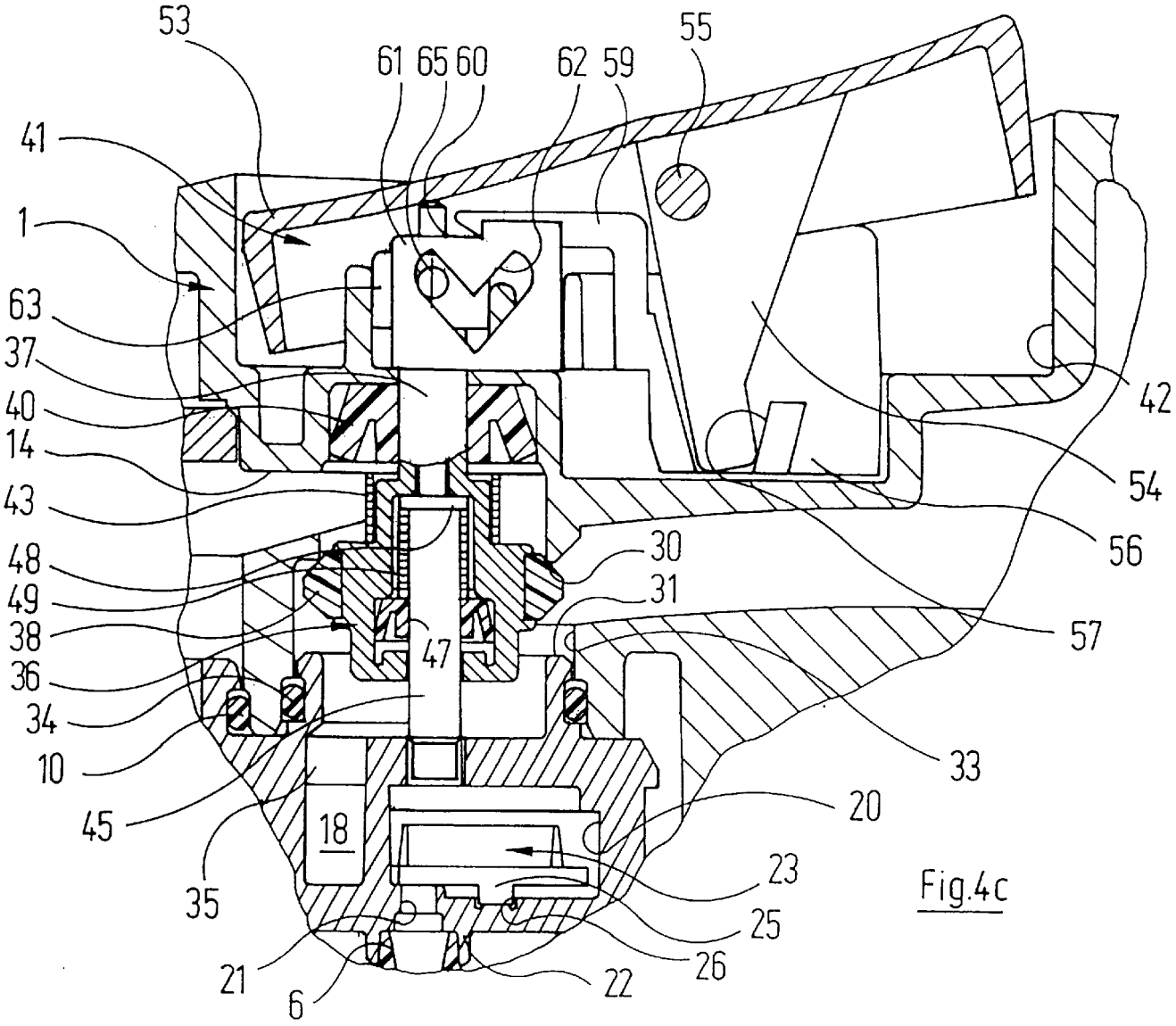
Figure 5:
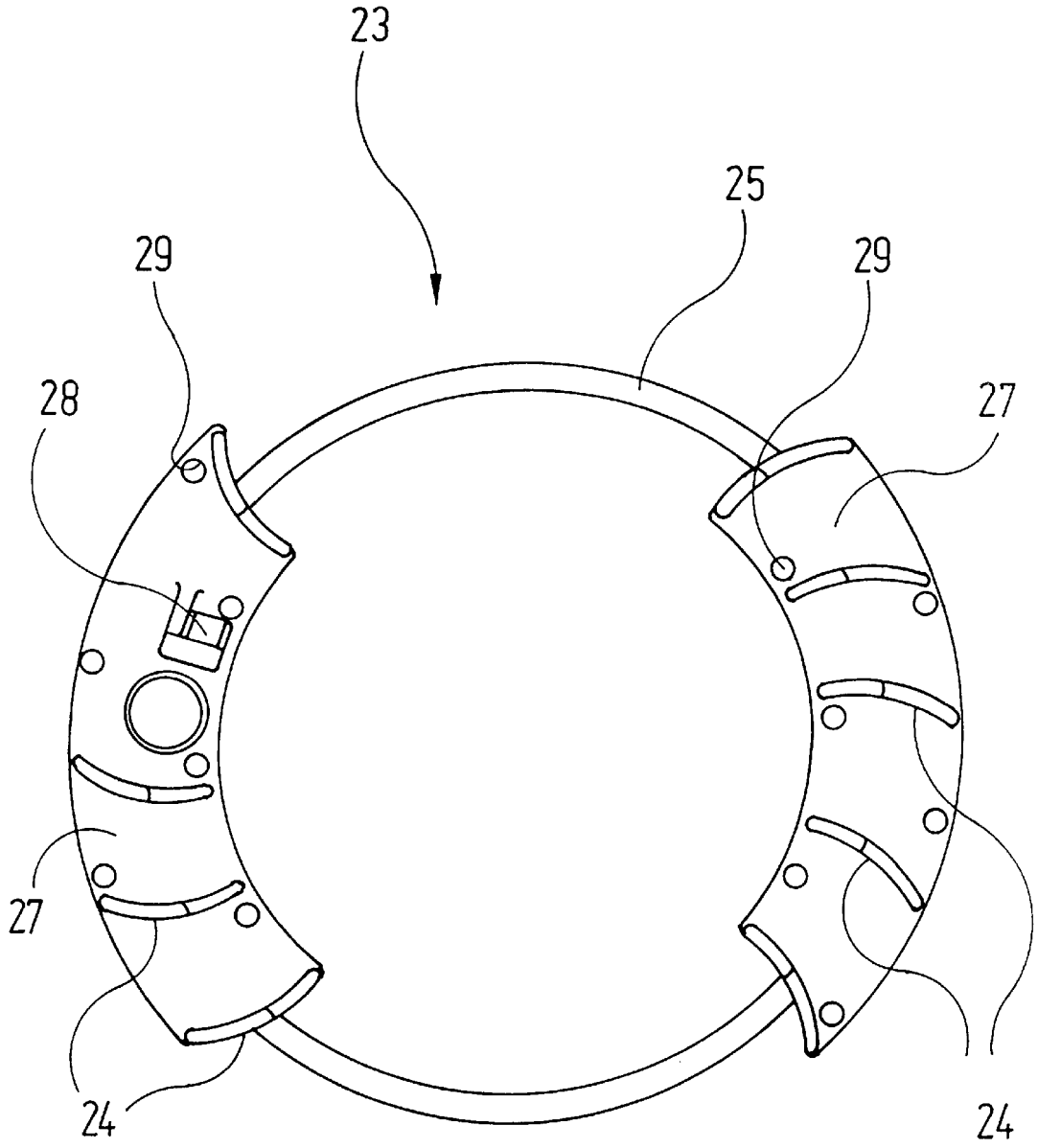

One embodiment of the invention is explained in greater detail with the aid of the drawings, as follows:

FIG. 1: shows a section through a hand shower (cut off at the hand set);

FIGS. 2*a* to 2*c:* show, in greater scale, different views of sections through the change-over mechanism in the hand shower shown in FIG. 1 in a first mode of operation;

FIGS. 3*a* to 3*c:* show sections similar to those shown in FIGS. 2*a* to 2*c* but in a second mode of operation;

FIGS. 4*a* to 4*c:* show sections similar to those illustrated in FIGS. 2*a* to 2*c* but in a third mode of operation of the hand shower;

FIG. 5: shows a plan view of the pulse wheel contained in the hand shower illustrated in FIG. 1.

FIG. 1 shows a section through the complete hand shower, with the aid of which the different internal water channels for the various modes of operation of the hand shower can first of all be explained. The hand shower illustrated basically consists, in the known manner, of a housing 1, which is extended in the area 1*a* to the left of the drawing to form a bell-shaped structure and which in the largely incomplete section to the right of FIG. 1 merges into a hand set 1*b*. The hand set 1*b* is hollow; its internal chamber 2 is used to supply the water, as is generally the norm in hand showers.

The extended bell-shaped section 1*a* of the housing 1 is sealed at the bottom by means of a shower base 3. In the embodiment illustrated, this is made up of an outer layer 3*a* made of an elastomer material which acts as an impact protection plate, and an inner rigid layer 3*b*. The shower base 3 is provided with two sets of water outlet openings 4, 5 which are arranged in concentric circles around the centre axis of the shower base 3. The water outlet openings 4 have a comparatively small cross-section; they are located at the outside end of a tubular jet insert 6 which extends quite a long way into the inner chamber of the housing. This jet insert 6 is also made of an elastomer material.

Correspondingly, the water outlet openings 5 which have a comparatively large cross-section are located at the outside end of tubular jet inserts 7 which, however, extend only a relatively short distance into the inner chamber of the housing 1. The tubular jet inserts 7 are also made of an elastomer material.

An insert 8 is secured inside the bell-shaped section 1*a* of the housing 1. This insert is a relatively complicated preform which although shown in the drawing as a single part is in fact generally made up of several parts. The insert 8 can roughly be divided into a section 8*a* which runs parallel to the shower base 3 and an essentially cylindrical insert 8*b* which extends upwards from the back of this area 8*a* shown in FIG. 1. The cylindrical insert 8*b* is inserted into a cylindrical wall 9 preformed on to the housing 1 and is sealed against this wall by means of an O-ring and secured in an axial direction to the shower base 3 in a suitable manner—for example by gluing or by locking (not illustrated).

The shower base 3 is attached to the insert 8 and thus to the housing 1 by means of a central fixing screw 11 which is screwed into a central graduated hole 12 in the insert 8.

Several circular chambers are moulded into the insert 8:

A first circular chamber 13 is located inside the cylindrical insert 8*b*. It is linked to a radial opening, pointing towards the hand set 1*b*, through the circular wall 9 of the housing 1.

The circular chamber 13 is also linked via a number of through holes 15 which are provided in its circular base to a second circular chamber 16 which opens into a water distribution chamber 17 which essentially extends over its entire surface parallel to the shower base 3. The water distribution chamber 17 is linked to the inside ends of the tubular jet inserts 7 which are part of the large cross-section water outlet openings 5.

In the area 8*a* of the insert 8 which extends parallel to the shower base there is recessed a third circular chamber 18 which is linked to a fourth circular chamber 20 via several through holes 19 spaced around the circumference. The fourth circular chamber 20 goes concentrically around the third circular chamber and has a greater radius.

There are provided in the base of the fourth circular chamber 20 and coaxial to each tubular jet insert 6, through holes 21 which have small cylindrical collars 22 going round their outer end which are preformed on to the underside of the insert 8. The cylindrical collars 22 receive the inside ends of the tubular jet inserts 6; the elastic properties of these tubular jet inserts 6 thus guarantees the leak-proof transfer of water from the fourth circular chamber 20 to the water outlet openings 4 with the small cross-section.

A pulse wheel 23 is mounted in the fourth circular chamber so that it can turn. As can be seen from FIG. 5, this wheel is equipped with a number of curved turbine blades 24 which essentially extend in a radial direction.

The pulse wheel 23 is controlled by means of a ring-shaped rib 25 preformed in one piece, which runs in a groove 26 in the bottom of the fourth circular chamber 20.

The rib of the pulse wheel 23 carries two diametrically opposite covering ring segments 27 each of which extends parallel to the base of the fourth circular chamber over an angle of about 90° and covers the through holes 21 in the corresponding peripheral area of the circular chamber 20. There is also preformed on to one of the covering ring segments 27, between the turbine wheels 24, a stop 28 which overlaps these axially. This stop is used to stop the pulse wheel 23 in a certain position of rotation, in a manner yet to be described. Numerous small through holes 29 are also provided in the covering ring segments 27 each of which, in the aforementioned blocked position of the pulse wheel 23, are aligned with a through hole 21 in the insert 8.

A first valve seat 30 pointing axially downwards is formed in the housing 1 of the hand shower between the inner chamber 2 of the hand set 1*b* and the through hole 14.

A second valve seat 31 is located coaxially to the first valve seat 30 on a cylindrical collar 32 on the insert 8 which is inserted into a complementary opening 33 in the housing 1 and is sealed against this by means of an O-ring 34.

The second valve seat 31 is linked to the third circular chamber 18 via through holes 35.

The two valve seats 30 and 31 act in combination with a two-way valve cone 36 with axial movement which consists of a shaft part 37 and the actual seal which acts in concert with the valve seats 30 and 31. The shaft part 37 of the two-way valve cone 36 is removed from the housing 1 via an opening 39 and the water is prevented from escaping from the inner chamber of the housing 1 by means of a shaped seal 40 fitted between the surface of the shaft part 37 and a corresponding wall of the housing. The outside end of the shaft part 37 is connected to a change-over mechanism which, altogether, is identified with the reference number 41 and is sometimes housed in a recess 42 in the top of the housing 1. It is described in greater detail later on.

The two-way valve cone 36 is loaded by means of a compression spring 43 which is tensioned between one graduation of the shaft part 37 and a shim 44 supported on the housing 1 in such a way that the seal 38 on the two-way valve cone is normally in the position shown in FIG. 1 and therefore seals the second valve seat 31.

The entire two-way valve cone 36 has a stop rod 45 going coaxially through it. The bottom end of this rod passes through a hole 46 which leads into the fourth circular chamber 20. A shaped seal 47 inserted between the surface of the stop rod 45 and a cavity inside the two-way valve cone 36 prevents the leakage of water from the fourth circular chamber.

The stop rod 45 can move axially inside the two-way valve cone 36. It can adopt two positions: in the first position which is shown in FIG. 1, the bottom end of the stop rod 45 extends so far into the fourth circular chamber 20 that it is in the path of movement of the stop 28 on the pulse wheel 23. When the stop 28 reaches the bottom end of the stop rod 45, the through holes 29 provided in the covering ring segment 27 are in line with the through holes 21 in the insert 8.

In the second axial position, the stop rod 45 is moved so far upwards that its bottom end is no longer located in the path of movement of the stop 28 on the pulse wheel 23, with the result that the pulse wheel 23 is then able to rotate completely freely.

A compression spring 49 tensioned between a beading 48 surrounding the stop rod 45 and the top of the shaped seal 47 pushes the stop rod 45 upwards inside the two-way valve cone 36.

Before giving any further details about the change-over mechanism 41 with which the positions of both the two-way valve cone 36 and also the stop rod 45 can be controlled, it would seem advisable to describe the three modes of operation in which the illustrated hand shower is capable of working. An understanding of these modes of operation will then make it easier to understand the role of the change-over mechanism 41.

The first mode of operation of the hand shower is shown in FIG. 1 and also in FIGS. 2*a* to 2*c*. In this mode, the second valve seat 31 is closed by means of the two-way valve cone 36. The water flowing through the inner chamber 2 of the hand set 1*b* flows past the first valve seat through the through hole 14 in the wall 9 of the housing 1 into the first circular chamber 13 of the insert 8*b*. From there, the water continues to flow through the openings 15 into the second circular chamber 16, then into the water distribution chamber 17 and then out via a circular screen 50 which overlaps the inside ends of the tubular jet inserts 7, As it enters the second circular chamber 16, the water which flows through the openings 15 in the form of numerous single jets is enriched with air which is drawn in via the radial holes 51 linking the circular chamber 16 with the middle graduated hole 12, the graduated hole 12 itself and also through the holes 52 in the shower base 3. The water which flows out of the water outlet openings 5 is therefore enriched with minute air bubbles. Owing to the relatively large cross-section of the water outlet openings 5, the shower jets produced in this instance are relatively slow. They are therefore perceived as being soft. The experts therefore refer to this mode as "soft jet mode".

The second mode of operation of the shower is obtained when the two-way valve cone 36 is moved upwards, thereby closing the first valve seat 30 and freeing the second valve seat 31. The stop rod 45 however is once again in the position in which its bottom end prevents the pulse wheel 23 from rotating freely. This situation is illustrated in FIG. 3*a* to 3*c*.

In this mode of operation, the water flowing through the inner chamber 2 of the hand set 1*b* flows through the openings 35 in the insert 8 into the third circular chamber 18 and from there via the radial openings 19 into the fourth circular chamber 20. If the stop 28 on the pulse wheel 23 is not yet at the bottom end of the stop rod 45, the turbine blades 24 turn the pulse wheel slightly until the stop 28 comes up against the stop rod 45. It is then no longer possible to turn the pulse wheel 23 any further. The fourth circular chamber 20 now acts as a simple water distribution chamber, from which the water flows through the openings 21 in the base of the fourth circular chamber 20 and the tubular jet inserts 6 to the water outlet openings 4. The shower jets emerging in this instance are comparatively fast due to the geometry of the water outlet holes 4 and because they are not enriched with air are therefore perceived as being hard. This is therefore referred to as the "hard jet mode" of the hand shower.

In the third mode of operation of the hand shower, the two-way valve cone 36 is in the same position as it is in the second mode of operation: this means that it obstructs the first valve seat 30 and frees the second valve seat 31. The stop rod 45 on the other hand is now withdrawn axially upwards so that its bottom end no longer obstructs the rotation of the pulse wheel 23. The path taken by the water is the same as in the second mode of operation: the water flows through the inner chamber 2 in the hand set 1*b*, past the second valve seat 31, through the openings 35 into the third circular chamber 18 and from there it flows via the radial holes 19 into the fourth circular chamber 20 and out of this through the through openings 21 and the tubular jet inserts 6 to those water outlet openings 4 with the small cross-section. However, since the bottom end of the stop rod 45 is now no longer in the path of movement of the stop 28 on the pulse wheel 23, this is brought into rotation by the water flowing against the turbine blades 24. The covering ring segments 27 which form part of the pulse wheel now rotate over the through holes 21, alternately freeing them and then covering them again. The result of this is that the hard jets emerging from the water outlet openings 4 are also periodically interrupted and therefore "pulse". This is therefore referred to as "pulse jet mode" or "massage jet mode".

The change-over mechanism 41 and its interaction with the two-way valve cone 36 and the stop rod 45 will now be described in greater detail below—that is to say the mode and manner in which the two-way valve cone 36 and the stop rod 45 are moved to bring about the three modes of operation. For this, reference is made first of all to FIGS. 2*a* to 2*c*.

As shown in these figures, the part of the change-over mechanism 41 which is housed in the recess 42 in the housing consists of a rocker-type manual actuator 53, hereinafter abbreviated to "rocker". The rocker 53 seals the recess 42 in the housing 1 at the top and protrudes only far enough for it to be easily operated. An actuating finger 54 which projects into the recess 42 is preformed on to the rocker 53. The upper area of this finger has a swivel pin 55 going through it which is held in the side walls of the housing 1. In this way, the rocker 53 can be pivoted about a horizontal axis defined by the swivel pin 55.

The bottom end of the actuating finger 54 engages in a guide recess 57 in a slide 56. The slide is carried inside the recess 42 so that, by a suitable configuration of its side wall and the adjacent wall of the housing, it can move in the direction of the double arrow 58. By pressing the rocker 53, the arrangement obviously allows the slide 56 to be moved linearly inside the recess 42, and in fact between three positions which correspond to the three modes of operation of the hand shower described above. FIGS. 2*a* to 2*c* show the centre position of both the rocker 53 and also the slide 56 which correspond to the first mode of operation of the hand shower, that is to say "soft jet mode".

There is preformed on to the top of the slide 56 an arm 59 which runs approximately parallel to the direction of the arrow 58, at the end of which there is an inclined cam surface 60.

A guide plate 61 with a V-shaped guide slot 62 is preformed on to each of the two sides of the arm 59 on the slide 56. Only part of the guide plate 61 located behind the drawing plane can be identified in FIGS. 2*a* and 2*b*. The front guide plate 61 has been omitted in line with the section. The interface is marked by the hatched rectangle 68. FIG. 2*c* on the other hand illustrates another area at the top end of the two-way valve cone 36, with the result that the guide plate 61 which is actually located in front of the sectional plane and the way in which it is connected to the arm 59 on the slide 56 can clearly be identified.

The top end of the shaft part 37 is spherical in form, as can be seen particularly in FIG. 2*a*. It is carried by a complementary inner surface of a two-part guide ring 63 which is partially spherical in form. The guide ring 63 is carried in a cylindrical collar 64 preformed on to the base of the recess 42 in the housing 1 and can be moved in an axial direction. Two diametrically opposed guide pins 65 project from the surface of the guide ring 63 vertical to the drawing plane, as can be seen from FIGS. 2*b* and 2*c*. The guide pins 65 are carried by the guide slots 62 in the respective adjacent guide plates 61. This can be seen particularly in FIG. 2*c*.

In the first mode of operation, that is to say in the "soft jet mode", the relative position of the slide 56 and in particular the V-shaped guide slots 62 provided in the guide plates 61 in respect of the top end of the two-way valve cone 36 is such that the guide pins 65 are located in the bottom apex of the V-shaped guide slot 62. This is illustrated in FIG. 2*c*. The position in which the two-way valve cone 36 is able to adopt the bottom-most position in which its seal 38 closes the second valve seat can clearly be seen. By virtue of the inner positive closure between the shaft part 37 of the two-way valve cone and the stop rod 45 the latter is also in its bottom-most position in which its bottom end therefore extends into the fourth circular chamber 20. The top end of the stop rod 45 is a short distance away, opposite the cam surface 60 on the arm 59 of the slide 56.

Now let us assume that the hand shower is required to be changed over from the first mode of operation shown in FIGS. 2*a* and 2*c* into the second mode of operation in which hard jets emerge from the water outlet openings 4 in the shower base which are not pulsed and therefore not interrupted. To achieve this, the rocker 53 is pressed in the area to the right of the swivel pin 55 as shown in FIGS. 2*a* to 2*c* such that the actuating finger 54 is rotated in a clockwise direction. Starting from the relative positions shown in FIGS. 2*a* to 2*c,* the relative positions are now reached which are illustrated in FIGS. 3*a* to 3*c*.

It can first of all be seen from FIG. 3*a* that the underside of the arm 59 on the slide 56 has been pushed over the top end of the stop rod 45. The stop rod 45 is therefore once again prevented from moving from the axial position in which its bottom end obstructs the pulse wheel.

It is, however, a different matter with the two-way valve cone 36: as can be seen from FIG. 3*c* in particular, the guide pins 65 on the guide ring 63 are pushed into the right-hand side of the V-shaped guide slot 62 as shown in the drawing by moving the slide 56 linearly to the left. Owing to the inclined position of this side, the guide pins 65 are drawn upwards in a kind of cam action; owing to the positive closure between the guide ring 63 and the shaft part 37 of the two-way valve 36, the latter follows, moving axially upwards until it seals the first valve seat 30 as shown in FIGS. 3*a* and 3*c*. Since, as already mentioned, with this axial movement of the two-way valve cone 36 the stop rod 45 stops axially, the compression spring 49 mounted between the two-way valve cone 36 and the stop rod 45 is consequently compressed. The circumstances are now obviously as required for the second mode of operation: the water is able to flow past the second valve seat 31, through the third circular chamber 18 into the fourth circular chamber 20 and from there to the water outlet openings 4, but the stop rod 45 still obstructs the rotation of the pulse wheel 23.

The third mode of operation is obtained from the "centre position" of the rocker 53 and the slide 56 shown in FIGS. 2*a* to 2*c*. This third mode is one in which pulsed hard jets emerge from the water outlet openings 4 by the user pushing the rocker 53 to the side to the left of the swivel pin 55 as shown in the drawing. The actuating finger 54 of the rocker 53 now rotates anticlockwise and moves the slide 56 to the right, from the position shown in FIGS. 2*a* to 2*c*. The relative positions of the various parts are shown in FIGS. 4*a* to 4*c*.

With regard to the axial position of the two-way valve cone 36, the circumstances are obviously completely identical to those in the second mode of operation as shown in FIGS. 3*a* to 3*c*. The only difference is that the guide pins 65 on the guide ring 63 are now pushed into the left-hand side of the guide slot 62 as shown in the drawing. The lifting movement of the guide ring 63 and thus the entire two-way valve cone 36, however, occurs by virtue of the cam action in completely the same way as in the second mode of operation. In this respect, the conditions for any movement to the right and left from the "centre position" shown in FIGS. 2*a* to 2*c* are, as can be seen, symmetrical.

This is not the case, however, with the stop rod 45:

By moving the slide 56 to the right vis-a-vis FIGS. 2*a* to 2*c,* the top end of the stop rod 45 moves outside the range of the arm 59 on the slide 56, as can be seen particularly in FIGS. 4*a* and 4*b*. By the action of the compression spring 49, following the movement of the two-way valve cone, the stop rod 45 is now pushed upwards with the result that the bottom end of the stop rod 45 moves upwards out of the fourth circular chamber 20 and frees the movement of the pulse wheel 23. The circumstances are now as they are required for the third mode of operation: the water flows past the second valve seat 31 and through the third circular chamber 18 into the fourth circular chamber 20, where the pulse wheel is able to turn freely. The desired pulse hard jets (pulse or massage jets) now emerge from the water outlet openings 4 in the shower base 3.

As soon as the water supply is shut off, the compression spring 43 returns the two-way valve cone 36 into the position shown in FIGS. 2*a* to 2*c,* which is consequently the preferred position. The first mode of operation is therefore automatically set, so that the mode of operation when the water supply is renewed will be "soft jet mode".

Obviously it is possible to introduce appropriate design measures to convert the positions which correspond to FIGS. 3 or 4 into "preferred positions" which are set automatically when the shower is first turned on or—as described above—when the water supply is shut off.

I claim:

1. A multifunction hand shower in which at least two modes of operation can be selected in which the shower jets emerge at a relatively high speed and with a relatively small cross-section, namely in a first mode of operation in which the shower jets emerge in a constant stream and a second mode of operation in which the shower jets are periodically interrupted, which comprises:

(a) a housing;

(b) a shower base which seals the housing and which has a number of water outlet holes;

(c) a pulse wheel which is mounted in a circular chamber in the housing through which water flows so that it is capable of rotation and which, as it turns, periodically interrupts and then frees the through-flow of water to the appropriate water outlet openings in the shower base;

(d) a change-over mechanism to select the mode of operation which comprises:

i) a manual actuator;

ii) at least one first change-over device controlled by the manual actuator, which can be moved into at least two different positions and in this way determines the mode of operation of the shower, in which the first change-over device acts on a stop which, in the first position of the first change-over device, is located outside the path of movement of a stop mounted on the pulse wheel and which, in the second position of the first changeover device, is located in the path of movement of the stop on the pulse wheel such that the pulse wheel stops in a specific position of rotation, the change-over mechanism being designed to set a third mode of operation in which air shower jets emerge from the shower base at relatively glow speed and have a relatively large cross-section.

2. Hand shower according to claim 1, characterized in that the first change-over device is moved out of the housing in the radial direction relative to the shower base.

3. Hand shower according to claim 1, characterised in that the first change-over device is moved out of the housing in the axial direction relative to the shower base.

4. Hand shower according to claim 1, characterized in that the second change-over device (37, 63) consists of:

a) a shaft part (37) with a partially spherically shaped head;

b) a guide ring (63) with a partially spherical internal chamber in which the partially spherical head of the shaft part (37) is accommodated in such a way that it is form fit but can be rotated.

5. Hand shower according to claim 1, characterized in that the change-over mechanism comprises:

iii) a slide (56) which is contained in the housing (1) and which can be rotated either translationally or rotationally by the manual actuator (53) and which can adopt three different positions corresponding to the three modes of operation of the hand shower;

iv) a second change-over device (37, 63) which can be moved by the slide (56) into two different positions via a guide and cam mechanism (62, 65), in which the first position adopted is the "soft jet mode", and the second position is both the "hard jet mode" and also the "pulse jet mode", in which v) the first change-over device (45) which produces the second change-over between "hard jet mode" and "pulse jet mode" is pushed into one of its two positions by means of a spring (49) and vi) the slide (56) has a stop (59, 60) which, in one position of the slide (56) holds the first change-over device (45) which produces the change-over between "hard jet mode" and "pulse jet mode" against the force of the spring (49) in one of the two positions and, in a second position of the slide (56) allows the spring (49) to push this first change-over device (45) into the other of the two positions.

6. Hand shower according to claim 1, characterized in that the second change-over device (37, 63) which produces the change-over between "soft jet mode" on the one hand and "hard jet mode" and "pulse jet mode" on the other acts on a double valve cone (36) which acts in concert with two valve seats (30, 31) formed in the housing (1).

7. Hand shower according to claim 1, characterized in that both the first and second change-over devices (37, 45) can be moved parallel to one another and perpendicular to the direction of movement of the slide (56).

8. Hand shower according to claim 7, characterized in that the first change-over device (45) is carried coaxially inside the hollow second change-over device (37).

9. Hand shower according to claim 1, characterized in that the manual actuator (53) is a rocker which can be pivoted from a centre first position into a second position and into a third position.

10. Hand shower according to claim 9, characterized in that there is preformed on to the rocker (53) an actuating finger which engages in a guide recess (57) in the slide (56).

11. Hand shower according to claim 1, characterized in that the guide and cam mechanism (61, 62, 65) operate symmetrically relative to the centre position of the slide (56), whereas the stop (59, 60) on the slide (56) works asymmetrically relative to the centre position of the slide (56) in the sense that it obstructs the movement of the first change-over device (45) into the second position in only one out-of-centre position of the slide (56).

12. Hand shower according to claim 1, characterized in that the guide and cam mechanism (61, 62, 65) consists of:

a) at least one guide slot (62) on the slide (56);

b) at least one guide pin (65) which is connected to the second change-over device (37) and which engages in the guide slot (72).

13. Hand shower according to claim 12, characterized in that the guide and cam mechanism (61, 62, 65) consists of:

a) two guide slots (62) arranged on the slide (61) parallel to each other;

b) two guide pins (65) which project from the second change-over device (37, 63) on diametrically opposite sides and each of which engages in one of the two guide slots (62).

14. Hand shower according to claim 12, characterized in that each guide slot (62) is V-shaped.

15. Hand shower according to claim 1, characterized in that the stop on the slide (56) is formed by an arm (59) which extends from the slide (56) perpendicular to the direction of movement of the first change-over device (45).

16. Hand shower according to claim 15, characterized in that a cam surface (60) is mounted on the free end of the arm (59) which is set at an angle to the direction of movement of the slide (56).

* * * * *